US006084383A

United States Patent [19]

Borinsky et al.

[11] Patent Number: 6,084,383

[45] Date of Patent: Jul. 4, 2000

[54] SYNCHRONIZER MODULE FOR A MULTIVOLTAGE POWER SUPPLY

[75] Inventors: Daniel Borinsky, Petach Tikva; Anatoli Rapoport, Rehovot, both of Israel

[73] Assignee: ECI Telecom Ltd., Petah Tikva, Israel

[21] Appl. No.: 09/225,740

[22] Filed: Jan. 6, 1999

[51] Int. Cl.[7] ..... G05F 1/40

[52] U.S. Cl. ..... 323/268; 307/87

[58] Field of Search ..... 307/87, 61, 63; 323/268, 271, 272, 283, 284

[56] References Cited

U.S. PATENT DOCUMENTS 4,698,738 10/1987 Miller et al. ..... 363/65
4,812,672 3/1989 Cowan et al. ..... 307/64
5,309,348 5/1994 Leu ..... 363/71

OTHER PUBLICATIONS

Texas Instruments, Design Manual "TGC4000/TEC4000 CMOS Arrays", Dec. (1996), pp. 2–39 thru 2–41.

*Primary Examiner*—Shawn Riley
*Attorney, Agent, or Firm*—Browdy and Neimark

[57] ABSTRACT

A synchronizer module for a multivoltage power supply having at least two output rails, and comprising a respective voltage monitor having a first input coupled to each of the output rails for monitoring a supply voltage thereon and providing an enable signal on an output thereof when the supply voltages on all of the output rails reach a respective in-tolerance condition. A switching element connected in each of the output rails and is responsive to the enable signal for changing from a first open state to a second closed state.

31 Claims, 3 Drawing Sheets

SYNCHRONIZER MODULE FOR A MULTIVOLTAGE POWER SUPPLY

FIELD OF THE INVENTION

This invention relates to multiple voltage power supplies.

BACKGROUND OF THE INVENTION

Electronic devices frequently require more than a single voltage source and to this end are powered either by multiple power supplies or by a single power supply having multiple voltage outputs. In either case, synchronization between the actual initiation of multiple voltage sources applied indiscriminately to the same device can be critical and failure to synchronize can cause malfunction of the device or even damage thereto.

An example of the damage which can ensue is provided in the Texas Instruments TGC4000/TEC4000 design manual (1996) with regard to an Application Specific Integrated Circuit (ASIC) having voltage inputs of 5 volts and 3.3 volts. It is explained on page 2–39 that if the 3.3V supplied is turned on before the 5V supply, TGC4000/TEC4000 5V-tolerant buffers in a is logic 1 state can supply large amounts of current through their clamp diodes to the 5V supply pin. This can lead to excessive power dissipation in the TGC4000/TEC4000 device and a violation of current density limits. However, if the 5V supply is turned on before the 3.3V supply, the maximum drain-to-gate voltage of the n-channel transistors in the 5V-tolerant buffers exceeds the recommended value, and the effects of channel hot carriers can be accelerated.

This problem has been addressed in the art principally in two ways. Thus, according to one approach, also explained in the above-cited reference, mixed voltages are usually ramped. Thus, in a typical scenario, the 3.3V supply is ramped to full voltage first. During this operation, all the system components which are tolerant to a 5V supply are forced into a high-impedance state so as to be effectively voltage-insensitive. Once the 3.3V supply has reached its peak voltage, the 5V supply is then ramped up. For power-down sequencing, the 5V-tolerant system components are forced in the high-impedance state, whereupon the 5V supply is then shutdown, followed by the 3V supply. The additional components add to the cost of the power supply and use precious PCB real estate.

Alternatively, a switched power supply may be used, which can turn on power after a predetermined time. Such an approach is described in U.S. Pat. No. 5,309,348 (Leu) and is also expensive because of the cost overhead imposed by the switchable power supply.

There is therefore a need for a more compact arrangement using readily available circuit components, for allowing proper synchronization between multiple power supplies, whilst imposing minimum overhead cost and space overheads.

SUMMARY OF THE INVENTION

It is an object of the invention to provide a synchronizer module for a multiple voltage power supply whose outputs are synchronized so that no voltage is output from any leg of the module until all the voltages reach a stable condition, and to remove the voltage in a synchronized fashion in the event of any of the supplies going out of specified tolerance.

According to the invention there is provided a synchronizer module for a multivoltage power supply having at least two output rails, said synchronizer module comprising:

a respective voltage monitor each having a first input for coupling to a respective one of the output rails for monitoring a supply voltage thereon and providing an enable signal on an output of the voltage monitor when the supply voltages on all of the output rails reach a respective in-tolerance condition, and a respective switching element connected in each of the output rails and being responsive to the enable signal for changing from a first open state to a second closed state.

Preferably, each of the voltage monitors has a respective second input for applying thereto a disable signal for producing a corresponding disable signal on the respective output thereof, and the voltage monitors are connected in cascade such that an output of each voltage monitor is fed to the corresponding second input of an adjacent downstream voltage monitor. This ensures that a disable signal is produced at the output of a most downstream voltage monitor until the respective supply voltages monitored by all of the voltage monitors reach the respective in-tolerance condition.

Preferably, each of the voltage monitors is fed to an input of a logical AND-gate, such that a disable signal is produced at the output of the AND-gate until the respective supply voltages monitored by all of the voltage monitors reach the respective in-tolerance condition.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF PREFERRED EMBODIMENTS

Figure 1:
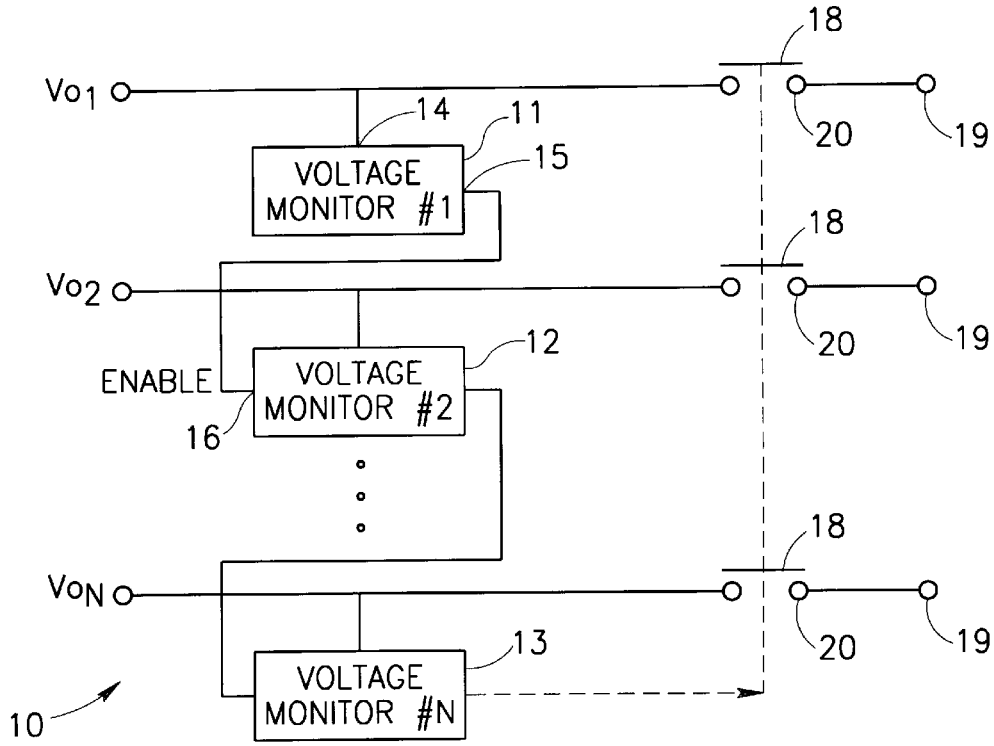
FIG. 1 shows schematically a synchronizer module for a multiple-voltage power supply according to a first embodiment of the invention.

FIG. 1 shows a synchronizer module depicted generally as 10 for a multiple voltage power supply. The multiple voltage power supply has N output rails $Vo_1$, $Vo_2$ . . . $Vo_N$. A respective voltage monitor 11, 12 and 13 and enumerated #1, #2 . . . #N has a first input 14 for coupling to a respective one of the output rails $Vo_1$, $V_2$ . . . $Vo_N$ for monitoring a supply voltage thereon and providing an actuation signal on a respective output 15 thereof when the supply voltage on the respective output rails $Vo_1$, $Vo_2$ . . . $Vo_N$ reaches an in-tolerance condition. The voltage monitors 11, 12 and 13 are connected in cascade such that the output 15 of each voltage monitor is fed to a corresponding ENABLE input 16 (constituting a second input) of an adjacent downstream voltage monitor. Thus, the output of the first voltage monitor 11 is connected to the ENABLE input 16 of the second voltage monitor 12, whose output is, in turn, connected to the ENABLE input of the third voltage monitor and so on.

A normally-open switching element 18 is connected in each of the output rails $Vo_1$, $Vo_2$ . . . $Vo_N$ and is responsive to the actuation signal of the $N^{th}$ voltage monitor 13 for changing from a first open state to a second closed state. A respective output terminal 19 is connected to a respective output 20 of each of the switching elements 18 for coupling a respective load (not shown) thereto. Thus, the actuation signal of the $N^{th}$ voltage monitor 13 constitutes an enable signal to which all of the switching elements 18 are responsive for switching the respective output rail $Vo_1$, $Vo_2$ . . . $Vo_N$ of each of the power supplies to the corresponding output terminal 19. The circuit operates as follows. When the voltage monitored by an active voltage monitor reaches an in-tolerance condition, an actuation signal is fed from the output of the corresponding voltage monitor to the ENABLE input of the next voltage monitor in the chain, which is otherwise disabled. When a voltage monitor is inactive, because no actuation signal is fed to its ENABLE input, its output is disabled even if the voltage on the output rail monitored by the voltage monitor has reached an in-tolerance condition.

Thus, for so long as any one of the output rails monitored by the voltage monitors has yet to reach its respective in-tolerance condition, or has varied from its in-tolerance condition, no actuation signal is produced by that voltage monitor which thus feeds a disable signal to the next voltage monitor in the chain. All subsequent voltage monitors in the chain thereby become inactive. This ensures that the output of the last voltage monitor in the chain, which serves as the enable signal for the switching elements 18, is disabled until all the monitored voltages reach their respective in-tolerance condition. In the event that the voltages have reached the in-tolerance condition, and have enabled switching elements 18, an out of tolerance condition from any single voltage source will be detected by the respective voltage monitor, and switching element 18 will then receive a disabling signal.

Figure 2:
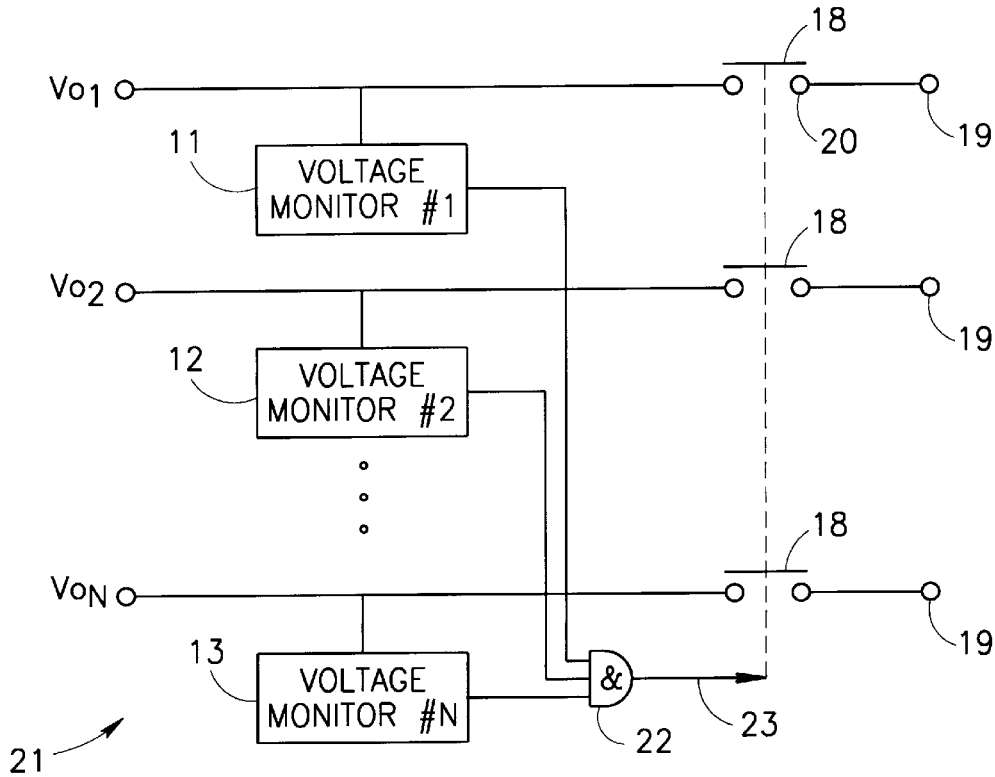
FIG. 2 shows schematically a synchronizer module for a multiple-voltage power supply according to a second embodiment of the invention.

FIG. 2 shows schematically an alternative embodiment similar to that shown in FIG. 1 but wherein the outputs of the voltage monitors are processed logically to determine when the power supplies are synchronized. To the extent that similar circuitry is employed in FIG. 2 as in the first embodiment shown in FIG. 1, identical reference numerals will be used.

A synchronizer module is depicted generally as 21 for a multiple voltage power supply. The multiple voltage power supply has N output rails $Vo_1$, $Vo_2$ . . . $Vo_N$. A respective voltage monitor 11, 12 and 13 and enumerated #1, #2 . . . #N has an input 14 for coupling to a respective one of the output rails $Vo_1$, $Vo_2$ . . . $Vo_N$ for monitoring a supply voltage thereon and providing an actuation signal on a respective output 15 thereof when the supply voltage on the respective output rails $Vo_1$, $Vo_2$ . . . $Vo_N$ reaches an in-tolerance condition. Respective outputs of the N voltage monitors 11, 12 and 13 constitute actuation signals which are connected as inputs to an N-input AND-gate 22. An output 23 of the N-input AND-gate 22 constitutes an enable signal which goes ACTIVE only when the respective actuation signal of all the voltage monitors is ACTIVE, thereby indicating that their voltage is within tolerance.

A normally-open switching element 18 is connected in each of the output rails $Vo_1$, $Vo_2$ . . . $Vo_N$ and is responsive to the enable signal for changing from a first open state to a second closed state. A respective output terminal 19 is connected to a respective output 20 of each of the switching elements 18 for coupling a respective load (not shown) thereto. Thus, the N-input AND-gate 22 constitutes a logic element for processing the actuation signals derived by each of the voltage monitors and to which all of the switching elements 18 are responsive for switching the respective output rail $Vo_1$, $Vo_2$ . . . $Vo_N$ of each of the power supplies to the corresponding output terminal 19.

Figure 3:
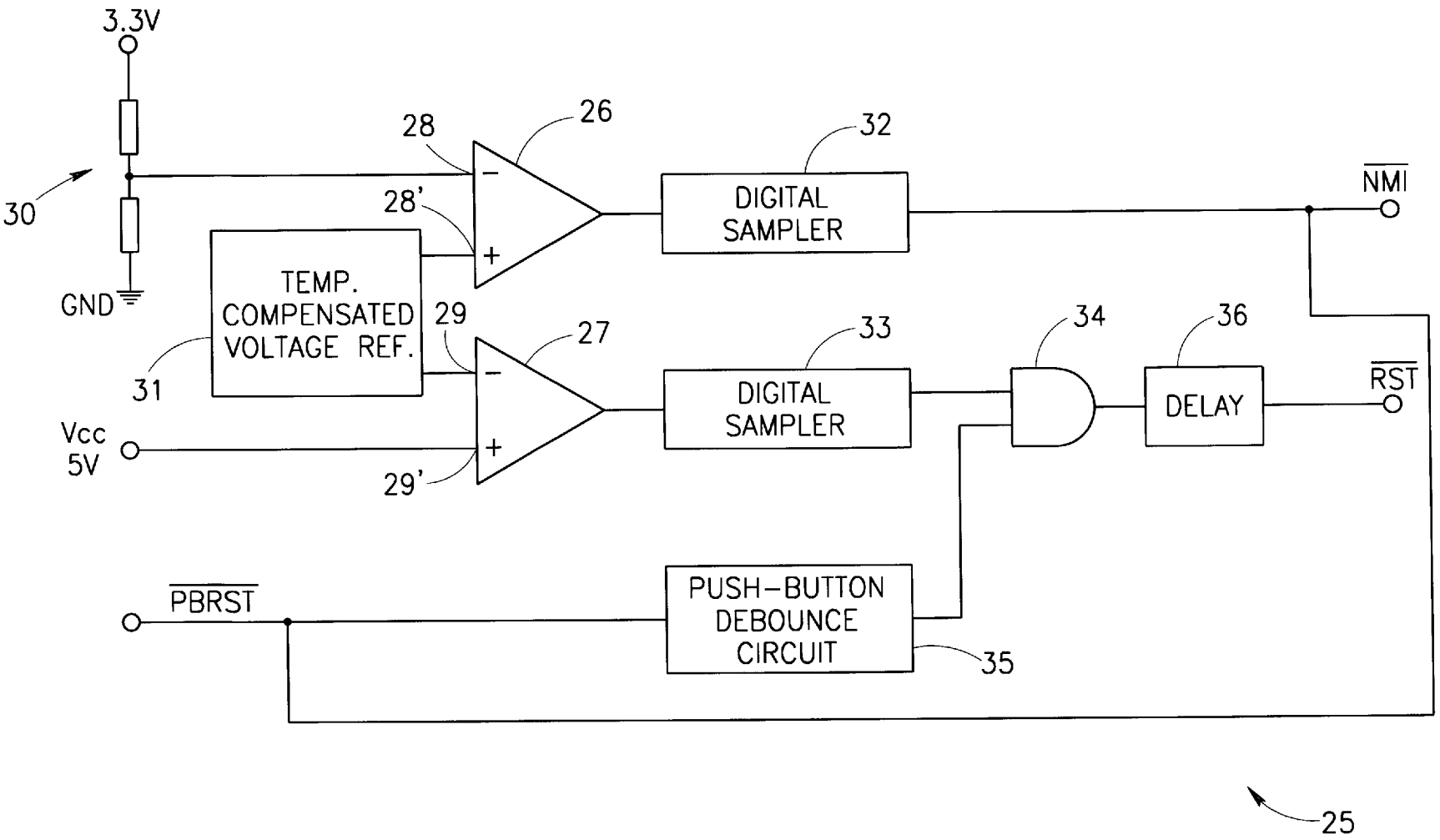
FIG. 3 is a schematic representation showing a detail of a dual-voltage synchronized power supply according to the first embodiment of the invention.

FIG. 3 is a schematic representations showing a detail of a synchronizing module 25 for use with a dual-voltage synchronized power supply according to a first embodiment of the invention based on Dallas Semiconductor's 5.0 volt voltage monitor integrated circuits sold under catalog number DS 1706. This chip is typically used to detect an out-of-tolerance condition consequent to a power failure, possibly caused by an irregular shutdown. The DS 1706 voltage monitor, as shown in the manufacturer's data sheet, comprises first and second comparators 26 and 27 having respective inverting and non-inverting inputs, shown as 28, 28' and 29, 29'. An input voltage $V_{IN}$ derived by a voltage divider 30 from a 3.3 volt voltage rail to be monitored is fed to the inverting input 28 of the first comparator 26 whose noninverting input 28' is fed from a temperature compensated voltage reference 31. The 5 volt supply voltage Vcc is connected to the non-inverting input 29' of the second comparator 27, whose inverting input 29 is connected to another output of the temperature compensated reference source 31. Generally, all supply voltages are filtered before the input to the voltage monitor. The outputs of the two comparators 26 and 27 are connected to respective first and second digital samplers 32 and 33, respectively. The output of the first digital sampler 32 designated $\overline{NMI}$ is fed back to a push-button reset input $\overline{PBRST}$ of a push-button debounce circuit depicted generally as 35. The push-button reset input $\overline{PBRST}$ forms part of an optional push-button circuit (not shown).

The output of the second digital sampler 33 constitutes an actuation signal which is fed to a first input of a two-input AND-gate 34 whose second input is connected to the push-button debounce circuit 35 and responsive to the push-button reset signal $\overline{PBRST}$. An output of the AND-gate 34 is fed to a digital delay circuit 36 whose output $\overline{RST}$ acts as the enable/disable signal to which respective switching elements 18 (shown in FIG. 1) are responsive for opening and closing. When the reset signal RST goes ACTIVE, the switching elements 18 remain open whilst when $\overline{RST}$ goes INACTIVE, the switching elements 18 close, thereby connecting the 3.3 volt and the 5 volt supplies to respective loads (not shown).

The circuit operates as follows. $\overline{NMI}$ constitutes a deactuation signal which remains ACTIVE for as long as the 3.3 volt input is out-of-tolerance. $\overline{NMI}$ is fed to the push-button reset control circuit 35 thus forcing the reset signal $\overline{RST}$ to remain ACTIVE regardless of the output of the second digital sampler 33 which goes ACTIVE when the 5 volt supply applied to the Vcc terminal reaches an in-tolerance condition. When the 3.3 volt supply reaches an in-tolerance condition, this is sensed by the first comparator 26 whose output $\overline{NMI}$ now goes INACTIVE. This is fed back to the push-button control circuit 35 causing its output to go INACTIVE thereby enabling the AND-gate 34 to pass the output of the digital sampler 33. Thus, voltage monitoring of the 5 volt supply is effectively disabled until the 3.3 volt supply reaches an in-tolerance condition. When the 5 volt supply reaches an in-tolerance condition, the output of the AND-gate 34 becomes ACTIVE, and after the built-in time delay provided by the time delay circuit 36, $\overline{RST}$ goes INACTIVE. The output $\overline{RST}$ of the time delay circuit 36 constitutes an enabling signal which, when INACTIVE, allows both voltage supplies to be switched to theit respective output rails. By effectively using the $\overline{NMI}$ output to monitor the 3.3 volt supply and feeding it back to enable or disable operation of the DS 1706 circuit, a single DS 1706 integrated circuit can be used to provide a composite enable signal indicative that both the 3.3 volt and the 5 volt supplies are intolerance.

It will be noted from FIG. 3 that the voltage signal fed to the $V_{IN}$ terminal which is used to sense the 3.3 volt supply is derived using a voltage divider 30, whilst the 5 volt supply is fed directly to the Vcc input of the DS 1706 circuit in parallel with the $\overline{NMI}$ output. The delay circuit 36 ensures that $\overline{RST}$ remains ACTIVE for a predetermined time delay (typically 130 ms) even after the two voltage supplies reach respective in-tolerance conditions.

The two voltage supplies fed to the synchronizing module 25 shown in FIG. 3 remain disconnected from their respective loads until the reset signal $\overline{RST}$ goes INACTIVE, whereupon the respective loads are then connected. Thus, the power supplies go substantially instantaneously from a situation of no-load to a situation of maximum load. There may be conditions when this is undesirable.

Figure 4:
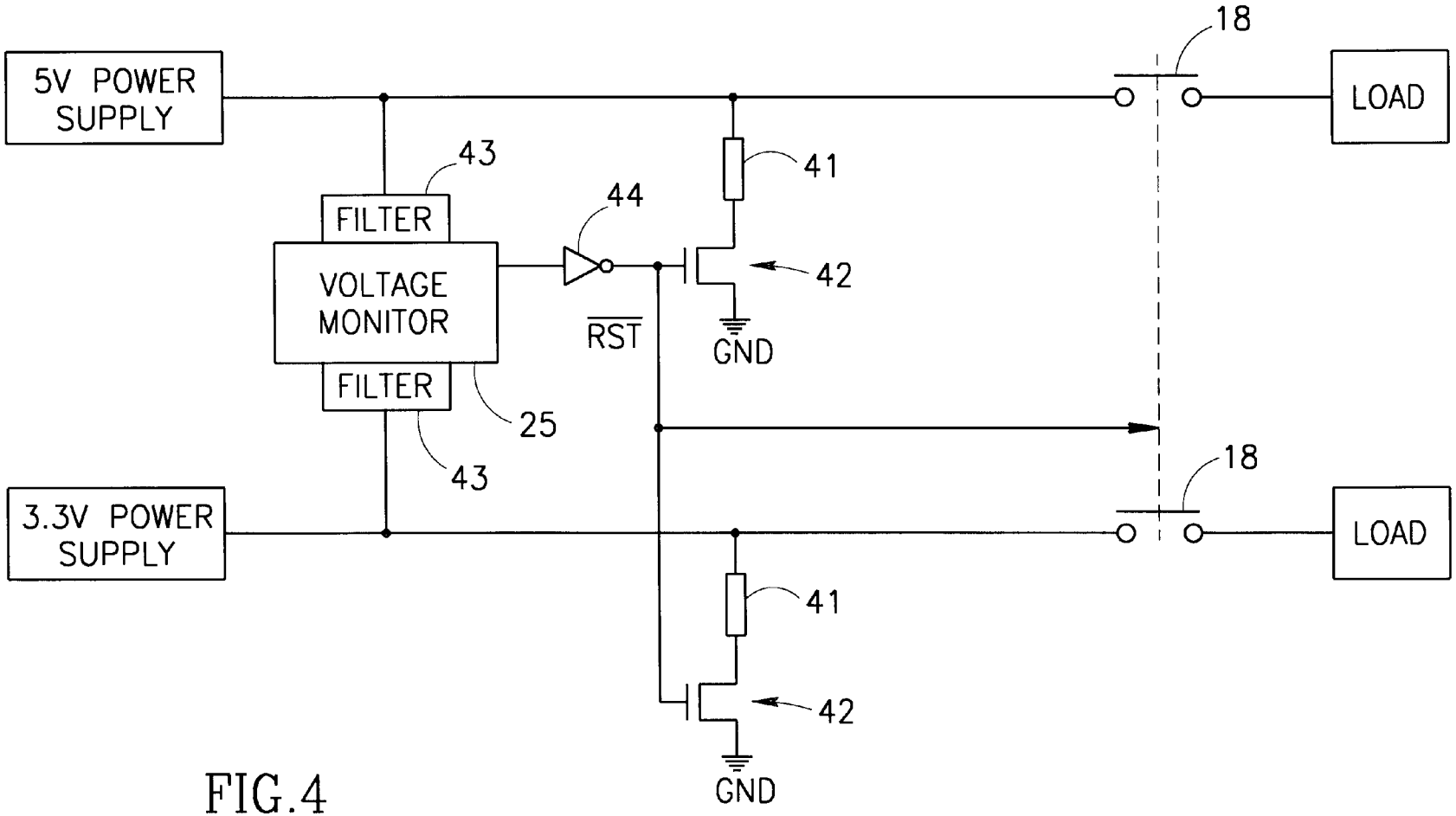
FIG. 4 is a schematic representation showing of a dual-voltage synchronized power supply having bleeder protection according to a third embodiment of the invention.

FIG. 4 shows schematically a block diagram of a dual-voltage power supply fed to a synchronizing module 25 including bleeder protection. A respective resistor 41 (constituting an auxiliary load) is connected to each power supply by a respective auxiliary switch 42 which is responsive to the reset signal $\overline{RST}$ going ACTIVE, for connecting the respective resistor 41. When the reset signal $\overline{RST}$ goes INACTIVE, the resistors 41 are disconnected. By such means when the primary load is connected, the auxiliary load is disconnected and the two power supplies are protected against a no-load condition. Also shown connected to each input of the voltage monitor 25 is a respective filter 43, which can be of a simple RC type to ensure proper operation of the monitor.

The switching elements 18 (shown in FIGS. 1 and 2) as well the auxiliary switches 42 are preferably constituted by MOSFETS whose gate terminals are connected to the output of the voltage monitor 25 via an inverter 44, such that when $\overline{RST}$ is ACTIVE, the MOSFET conducts and the resistor 41 acts as a load. In a preferred embodiment reduced to practice, p-channel enhancement mode transistors manufactured by Temic Semiconductors—Siliconix division under catalog number SUP/SUB75P03-08 were used, which have an extremely low turn on resistance and fast switching time.

It will be appreciated that, in use, the synchronizer module can be supplied as a separate unit for connection to the respective outputs of multiple power supplies. The power supplies can themselves be discrete units or an integral unit having multiple outputs. In such case, the power supply can include the synchronizer module as an integral component.

What is claimed is:

1. A synchronizer module for synchronizing respective voltages on at least two output rails, said synchronizer module comprising:

a respective voltage monitor each having a first input for coupling to a respective one of the output rails for monitoring a supply voltage thereon, the voltage monitors being interconnected to provide an enable signal when the supply voltages on all of the output rails reach a respective in-tolerance condition, a respective switching element connectable in each of the output rails and being responsive to the enable signal for changing from a first open state to a second closed state, and a respective output of each voltage monitor being fed to a logic element for logically processing said ouptputs and producing the enable signal only when all the respective voltages on the output rails are within tolerance.

2. The synchronizer module according to claim 1, wherein the logic element is an AND-gate.

3. The synchronizer module according to claim 1, wherein:

the enable signal is produced a predetermined time delay after the respective supply voltage reaches its in-tolerance condition, said predetermined time delay being sufficiently large that at the end of the predetermined time delay the respective supply voltage may be expected to have stabilized.

4. The synchronizer module according to claim 1, wherein:

the enable signal is produced a predetermined time delay after the respective supply voltage reaches its in-tolerance condition, said predetermined time delay being sufficiently large that at the end of the predetermined time delay the respective supply voltage may be expected to have stabilized.

5. The synchronizer module according to claim 1, wherein the voltage monitors are off-the-shelf integrated circuits.

6. The synchronizer module according to claim 1, wherein the voltage monitors are constituted by a single off-the-shelf integrated circuit.

7. The synchronizer module according to claim 6 for monitoring first and second voltages, wherein:

the integrated circuit is adapted to monitor the first voltage and produce an actuation signal when an in-tolerance condition is sensed, the integrated circuit is adapted to monitor the second voltage and produce a deactuation signal when an out-of-tolerance condition is sensed, and the deactuation signal is used to nullify the actuation signal even when the first voltage is in-tolerance.

8. The synchronizer module according to claim 7, further including a delay circuit for delaying the enable signal by a predetermined time delay after both supply voltage reach respective in-tolerance conditions.

9. The synchronizer module according to claim 1, wherein the switching elements are MOSFETs.

10. The synchronizer module according to claim 1, further including a respective auxiliary load connected to each power supply by a respective auxiliary switch which is responsive to the enable signal for opening and disconnecting the respective auxiliary load;

whereby each of the power supplies is protected against a no-load condition.

11. A multi-voltage synchronized power supply comprising the synchronizer module according to claim 1.

12. A multi-voltage synchronized power supply comprising the synchronizer module according to claim 3.

13. A multi-voltage synchronized power supply comprising the synchronizer module according to claim 7.

14. A synchronizer module for synchronizing respective voltages on at least two output rails for connecting to respective independent power inputs of an electronic device, said sychronizer module comprising:

a respective voltage monitor each having a first input for coupling to a respective one of the output rails for monitoring a supply voltage thereon, the voltage monitors being interconnected to provide an enable signal when the supply voltages on all of the output rails reach a respective in-tolerance condition, a respective switching element connectable in each of the output rails and being responsive to the enable signal for changing from a first open state to a second closed state.

15. The synchronizer module according to claim 14, wherein:

each of the voltage monitors has a respective second input for applying thereto a disable signal for producing a corresponding disable signal on the respective output thereof, and the voltage monitors are connected in cascade such that an output of each voltage monitor is fed to the corresponding second input of an adjacent downstream voltage monitor;

whereby no enable signal is produced at the ouput of a most downstream voltage monitor until the respective supply voltages monitored by all of the voltage monitors reach the respective in-tolerance condition.

16. The synchronizer module according to claim 14, wherein:

a respective output of each voltage monitor is fed to a logic element for logically processing said outputs and producing the enable signal only when all the respective voltages on the output rails are within tolerance.

17. The synchronizer module according to claim 16, wherein the logic element is and AND-gate.

18. The synchronizer module of claim 14, wherein:

the enable signal is produced a predetermined time delay after the respective supply voltage reaches its in-tolerance condition, said predetermined time delay being sufficiently large that at the end of the predetermined time delay the respective supply voltage may be expected to have stabilized.

19. The synchronizer module of claim 15, wherein:

the enable signal is produced a predetermined time delay after the respective supply voltage reaches its in-tolerance condition, said predetermined time delay being sufficiently large that at the end of the predetermined time delay the respective supply voltage may be expected to have stabilized.

20. The synchronizer module of claim 16, wherein:

the enable signal is produced a predetermined time delay after the respective supply voltage reaches its in-tolerance condition, said predetermined time delay being sufficiently large that at the end of the predetermined time delay the respective supply voltage may be expected to have stabilized.

21. The synchronizer module according to claim 14, wherein the voltage monitors are constituted by a single off-the-shelf integrated circuit.

22. The synchronizer module according to claim 14, wherein the voltage monitors are constituted by a single off-the-shelf integrated circuit.

23. The synchronizer module according to claim 22 for monitoring first and second voltages, wherein:

the integrated circuit is adapted to monitor the first voltage and produce an actuation signal when an in-tolerance condition is sensed, the integrated circuit is adapted to monitor the second voltage and produce an deactuation signal when an out-of-tolerance condition is sensed, and the deactuation signal is used to nullify the actuation signal even when the first voltage is in-tolerance.

24. The synchronizer module according to claim 23, further including a delay circuit for delaying the enable signal by a predetermined time delay after both supply voltage reach respective in-tolerance conditions.

25. The synchronizer module according to claim 14, wherein the swithching elements are MOSFETs.

26. The synchronizer module according to claim 14, further including a respective auxiliary load connected to each power supply by a respective auxiliary switch which is responsive to the enable signal for opening and disconnecting the respective auxiliary load;

whereby each of the power supplies is protected against a no-load condition.

27. A multi-voltage synchronized power supply comprising the synchronizer module according to claim 14.

28. A multi-voltage synchronized power supply comprising the synchronizer module according to claim 15.

29. A multi-voltage synchronized power supply comprising the synchronizer module according to claim 16.

30. A multi-voltage synchronized power supply comprising the synchronizer module according to claim 18.

31. A multi-voltage synchronized power supply comprising the synchronizer module according to claim 23.

* * * * *